United States Patent [19]

Stupp et al.

[11] 4,453,109

[45] Jun. 5, 1984

[54] MAGNETIC TRANSFORMER SWITCH AND COMBINATION THEREOF WITH A DISCHARGE LAMP

[75] Inventors: Edward H. Stupp, Spring Valley; Mark W. Fellows, Monroe; Walter G. Steneck, Ossining, all of N.Y.; Vincent J. Spataro, Bergenfield, N.J.

[73] Assignee: North American Philips Corporation, New York, N.Y.

[21] Appl. No.: 382,511

[22] Filed: May 27, 1982

[51] Int. Cl.[3] ..... H05B 41/29

[52] U.S. Cl. ..... 315/219; 315/106; 315/278; 315/282; 315/DIG. 7; 336/165; 336/214

[58] Field of Search ..... 315/106, 209 R, 219, 315/224, 276, 278, 282, DIG. 5, DIG. 7; 336/83, 165, 212, 214

[56] References Cited

U.S. PATENT DOCUMENTS

| | | | |
|---|---|---|---|
| 3,710,177 | 1/1973 | Ward | 315/106 |
| 4,213,076 | 7/1980 | Walz | 315/282 |
| 4,288,724 | 9/1981 | Sherman | 315/276 X |
| 4,388,562 | 6/1983 | Josephson | 315/278 X |

*Primary Examiner*—Eugene R. LaRoche

*Attorney, Agent, or Firm*—Thomas A. Briody; Robert T. Mayer

[57] ABSTRACT

A magnetic transformer switch which switches its primary flux path upon conduction in its secondary and the combination thereof with a fluorescent lamp in which the heater current is reduced upon lamp ignition by reason of the current in the heater winding in the secondary being reduced upon the primary flux path being switched. A unique construction minimizes both electromagnetic interference and induction losses.

11 Claims, 3 Drawing Figures

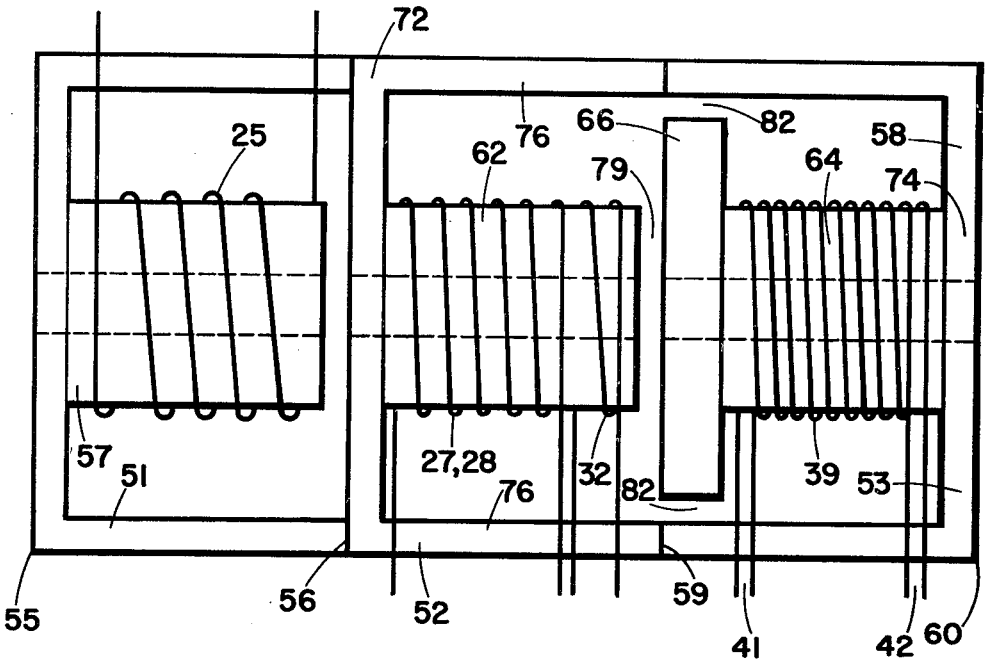
Fig. 2
Fig. 3
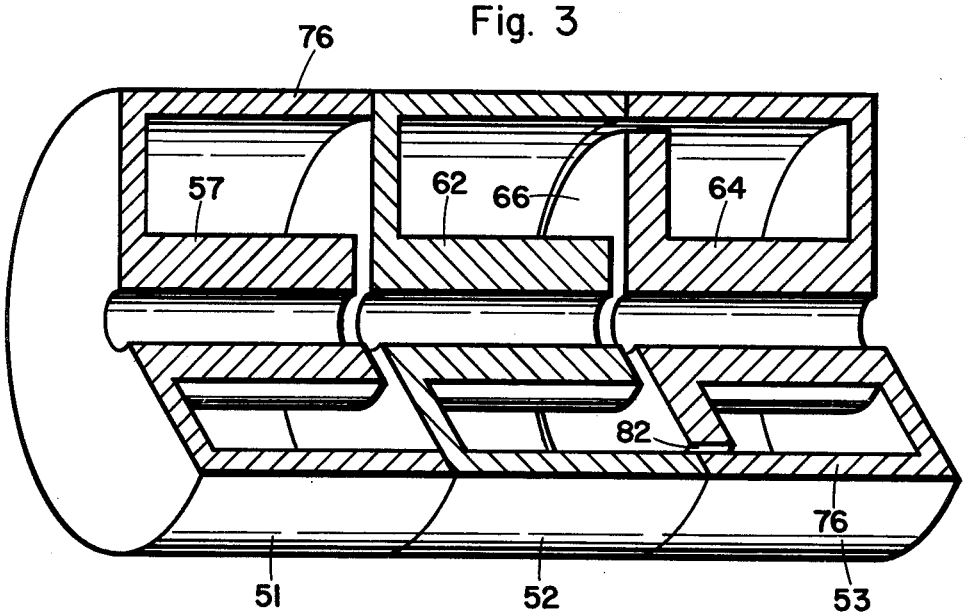

MAGNETIC TRANSFORMER SWITCH AND COMBINATION THEREOF WITH A DISCHARGE LAMP

This invention relates to a magnetic transformer switch and the combination thereof with a gas discharge lamp.

The prior art has employed a variety of techniques for energizing and ballasting electric discharge lamps. The early ballast circuits were energized by means of a DC voltage or a 60 Hz AC voltage. In the case of an AC supply voltage, this necessitated the use of a rather large magnetic ballast transformer. These early ballast circuits were characterized by a relatively poor efficiency caused in part by the relatively large power losses in the ballast system itself. More recently it has been proposed to improve the efficiency of a system for energizing discharge lamps by operating the lamps at a high frequency, generally in a range of 15 KHz to 50 KHz.

The present invention provides a novel magnetic impedance transformer for coupling the inverter oscillator to the discharge lamp. A high frequency leakage reactance transformer is used to provide an automatic reduction in the heater power or current supplied to the discharge lamp filament electrodes once the lamp ignites thereby producing a so-called auto-heat mode of operation. At the same time, the leakage reactance of the transformer also produces a ballast function to protect the discharge lamp.

Leakage reactance transformers, particularly those that operate at high frequencies, can produce significant levels of electromagnetic interference. When such transformers are proximate metallic structures and enclosures they often suffer high induction watt losses. The present invention provides a structural configuration which minimizes both electromagnetic interference and induction losses.

It is a prime object of the present invention to provide an improved magnetic transformer switch.

A further object of the invention is to provide an improved magnetic transformer switch in combination with a gas discharge lamp.

Still another object of the invention is to provide an improved leakage reactance transformer.

A further object of the invention is to provide a leakage reactance transformer which produces low electromagnetic interference.

A still further object of the invention is to provide a leakage reactance transformer which does not exhibit increased induction losses in the presence of metallic structures.

One of the features of the invention is to provide a high frequency oscillator-inverter with a novel leakage reactance transformer which provides not only inductive ballasting of a discharge lamp, but also automatic control of the lamp filament currents to provide optimum cathode temperature before and after lamp ignition thereby providing extended lamp life and higher system efficiency due to a reduction in system power losses.

One of the advantages of the invention is that it provides an improved high frequency ballast transformer that will simultaneously provide automatic control of the lamp heater power and high efficiency ballasting of the lamp operating current.

The high frequency transformer for coupling the oscillator to the lamp may consist of a new leakage reactance transformer arrangement which provides not only the current limiting ballast function but also automatic control of the heater power for the discharge lamp. The transformer produces a heater power (current) that has an inverse relationship to the lamp current. In particular, the heater power is automatically reduced after ignition of the discharge lamp in order to provide the optimum cathode temperature for extended lamp life due to minimum deterioration of the cathode.

The high frequency leakage transformer consists of a hollow ferromagnetic body (e.g. a ferrite material) encapsulating a core including a primary section and a secondary section linearly separated by a first air gap. Part of the secondary section adjacent the first air gap is a shunt section with a diameter larger than the core. The shunt section forms a second ring-shaped air gap with the outside walls of the ferromagnetic body. A primary winding, in conjunction with an adequate cross-section of the ferrite core, will insure that the transformer primary core section does not saturate. Preferably, the transformer is dimensioned so that no portion of the entire transformer core will be allowed to saturate, thereby producing low power dissipation in the transformer, low signal distortion and optimum power coupling.

The transformer secondary winding is mounted on the transformer secondary section and is physically separated from the primary winding and functions as a leakage reactance (inductance) which is coupled to the primary only via the magnetic field.

The transformer secondary section also includes the filament heating windings for a discharge lamp which normally will have a low turns ratio relative to the secondary winding turns. The heater windings are preferably tightly coupled to the secondary winding.

In operation before ignition of a discharge lamp, essentially all of the magnetic flux generated by the primary winding links the secondary through the first air gap to provide the maximum heater power for the lamp filaments as well as the requisite high open circuit voltage for ignition of the lamp. After ignition, some of the primary magnetic flux is coupled through the second ring-shaped air gap of the transformer so that the flux linkage between the primary and secondary windings decreases, resulting in a reduced cathode heater power. The change in flux coupling to the secondary section is related to the current flowing in the secondary winding and through the lamp. A decrease in lamp current results in an increase of heater current and vice versa so that the heater power bears an inverse relationship to the lamp current. This mode of operation is termed the auto-heat mode and results in higher efficiency due to the reduction in heater power during lamp operation. The reduced coupling to the secondary after lamp ignition provides a leakage reactance for limiting the lamp current.

In conventional leakage reactance transformers, an open frame construction, such as an E-core, is employed. In these types, the leakage flux in the shunt section can couple to other structures and produce electromagnetic interference or induce dissipative currents in metallic structures which increase losses. The constructed embodiment of the present invention with its cylindrical shape is self-shielding in that the leakage flux is totally contained within the magnetic structure which virtually eliminates these effects.

In accordance with the invention there is provided a magnetic transformer switch including a primary section, a secondary section and a connecting section having first and second parts between the primary and secondary section. A primary winding is wound on part of the primary section and a secondary winding is wound on part of the secondary section. The primary section and the secondary section have a first air gap between them. The primary, secondary and connecting sections and the first air gap form a first primary flux path. The secondary section and the connecting section have a second air gap between them. The secondary section, a first part of the connecting section and the second air gap form a secondary flux path. The primary section, a portion of the secondary section, the first and second air gaps and the second part of the connecting section form a second primary flux path. In response to a predetermined flux flowing in the secondary flux path as a result of current flowing in the secondary winding the primary flux switches from the first primary path to the second primary path.

Other objects, features and advantages of the invention will become apparent from the following description and appended claims when considered in conjunction with the accompanying drawings, in which:

FIG. 2 shows an improved leakage reactance transformer adapted for use in the apparatus of FIG. 1 for coupling the oscillator-inverter stage to a discharge lamp; and FIG. 3 is an isometric view of part of a preferred embodiment of the transformer disclosed herein.

Figure 1:
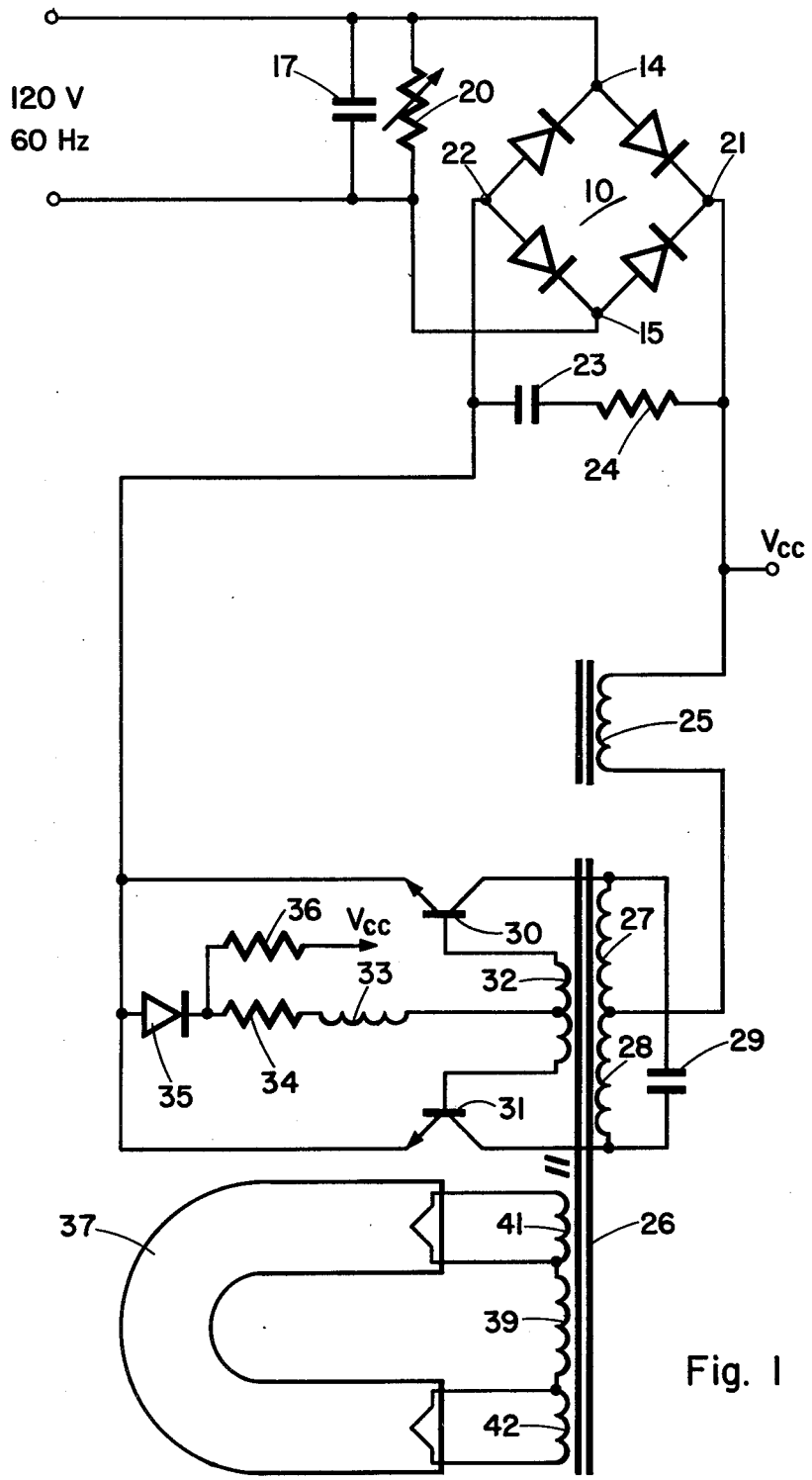
FIG. 1 is an electric schematic diagram of an oscillator-inverter for the ignition and operation of a gas discharge lamp.

Referring to FIG. 1 of the drawing, a 120 volts 60 Hz, AC supply voltage is coupled across bridge rectifier 10. Capacitor 17 is connected across bridge input terminals 14 and 15 to provide normal (differential) mode rejection of high frequency conducted radiation. Varistor element 20 is coupled across terminals 14 and 15 to provide transient voltage suppression and protection of the ballast circuit from the AC power lines by virtue of its voltage dependent nonlinear resistance function. Upon the occurence of a high voltage transient across varistor 20, its impedance changes from a very high value (approximately open circuit) to a relatively low value so as to clamp the transient voltage effectively to a safe level. The inherent capacitance of varistor 20 will provide an added filter function.

Bridge rectifier 10 rectifies the 60 Hz line voltage applied to its input terminals 14, 15 to derive at output terminals 21, 22 a pulsating DC output voltage with a 120 Hz modulation envelope. The maximum voltage will correspond to the peak voltage of the 60 Hz AC input voltage. Smoothing capacitor 23 is chosen so that the minimum voltage will insure that a discharge lamp supplied with power from such source does not extinguish at any time within any 60 Hz period of operation. Resistor 24 provides additional transient protection.

Output 21 of rectifier 10 is connected through inductor coil 25 to the center tap of transformer primary winding 27, 28. Inductor coil 25 is formed as part of the structure of the high frequency coupling transformer 26 and is gapped to handle a DC current. Capacitor 29 is connected in parallel with primary winding 27, 28 and has a capacitance value chosen to resonate with the primary inductance at the selected frequency of the oscillator-inverter circuit.

NPN switching transistors 30, 31 have their collector electrodes respectively connected to opposite ends of the primary winding 27, 28 and their emitter electrodes connected to output terminal 22 of bridge rectifier 10. This circuit comprises a current fed (via series inductor 25) parallel resonant (27–29) switched mode power oscillator/amplifier. The circuit is extremely efficient in generating a high frequency output and, if all components were ideal (no losses), it would have an efficiency of 100%. A practical circuit will have an efficiency exceeding 95%.

Base drive winding 32 has its end terminals connected to the base electrodes of switching transistors 30 and 31 and its center tap connected to bridge output terminal 22 via a series circuit consisting of inductor 33, resistor 34 and diode 35. Winding 32 and series circuit 33–35 demonstrate one means for providing the switching drive signals for transistors 30 and 31. Other appropriate base drive circuits for bipolar transistors may also be used.

Starting resistor 36 couples voltage supply $V_{cc}$ (terminal 21) to the junction point between resistor 34 and diode 35 so as to apply a voltage to the base electrodes of the switching transistors in order to start the circuit oscillating. The base drive circuit provides essentially a square wave of current to the transistors so that the transistor switches are driven into a saturation state in the on condition.

The inverter circuit for converting the DC supply voltage into a high frequency AC voltage is thus seen to consist of a pair of active switches, transistors 30, 31, and a tuned parallel resonant circuit 27–29. The transistor switches are driven by the base drive circuit 32–35 so that they act like a two pole switch which defines a rectangular current waveform. As the resonant circuit is tuned to the switching frequency, harmonics are removed by it so that the resultant output voltage is essentially sinusoidal. The choke coil 25 forces essentially a constant DC current into the center tap of primary winding 27, 28. Each switching transistor carries the full DC current when it is on so that the current through each transistor varies from zero to a maximum. The switching transistors conduct in mutually exclusive time intervals.

Discharge lamp 37 is connected to transformer secondary winding 39 and heater winding 41, 42. The discharge lamp may, for example, be a conventional fluorescent lamp, which in the preferred embodiment is an 18 watt one. The lamp cathodes are heated by means of transformer secondary windings 41 and 42. In this case, the output voltage of each of these windings will be chosen to conform to the requirements for igniting rapid start lamps.

In order to insure that the lamp will not "instant start", the open circuit voltage across windings 39, 41, 42 is adjusted, by means of the transformer winding turns ratio, to be lower than the value required to instant start a discharge lamp.

FIGS. 2 and 3 illustrate an impedance transformation device in the form of a new leakage transformer configuration taht provides both a current limiting (ballast) function and an automatic control of the lamp heater power so as to improve the efficiency of the overall power supply-ballast system. The leakage transformer will couple the oscillator-inverter circuit to the discharge lamp. Inductive ballasting of the discharge lamp is achieved by means of the leakage reactance of the transformer itself. As shown in FIG. 1 the lamp is connected directly across the transformer secondary winding 39 and the heater windings 41 and 42 so that the varying reactance of the secondary will limit and control the lamp volt-ampere requirements. This leakage transformer attangement provides a significant reduction in radiated and conducted RFI.

The high frequency leakage transformer comprises a plurality of pot cores 51, 52 and 53 (FIGS. 2 and 3). In the constructed embodiment, each core is composed of 3C8 ferrite material. Core 51 is a Ferroxcube type 2616P-L00-3C8 with its outer walls 0.317 inches long from 55 to 56. Its cylindrical inner post-like section 57 is shorter by 0.018 inches. Coil 25 comprises 170 turns of 30 AWG wire. The choke comprising coil 25 and core 51 is unique in that no separate magnetic structure is required for closing its magnetic path. It utilizes end 72 of core 52 to complete its magnetic structure. Alternatively, core 51 could be joined to core 53 rather than core 52 in which case, end 74 would complete its magnetic structure.

Core 52 is part of the structure of transformer 26 which is formed by joining cores 52 and 53 together at their major openings to form a substantially closed hollow cylinder 58. Both cores are extended Ferrocube type 2616P-L00 with outer walls 0.383 inches long from 56 to 59 and from 59 to 60. Cylindrical inner post-like member or section 62 of primary core 52 is 0.065 inches shorter. Cylindrical inner post-like member or section 64 of secondary core 53 is 0.017 inches shorter than its outside walls. The space between sections 62 and 64 is thus 0.082 inches wide.

Primary winding 27, 28 consists of 70 turns, preferably bifilar, of 30 AWG wire. Secondary winding 39 including heater windings 41 and 42 consists of 200 turns of 30 AWG wire. Heater windings 41 and 42, comprising additional winding means, are six turns each of 30 AWG, tapped. In the constructed embodiment all windings were wound on lexan bobbins, not shown, fitted on the cylindrical sections of all cores.

Disc 66 has a diameter of 0.772 inches and a thickness of 0.071 inches. As those skilled in the art will understand various modifications can be made in these dimensions, which, if proper, will not change the operation of the apparatus. One of the faces of disc 66 is attached to the open end of cylindrical section 64 so that a first air gap 79 is formed between the open face of disc 66 and the open end of cylindrical section 62. This air gap is 0.011 inches wide. A second air gap 82 is formed between the edge of disc 66 and the inner wall of hollow cylinder 58 which is 0.039 inches wide.

The secondary portion of the transformer is not electrically connected to the primary winding and will provide both the transfer of energy to the load and the control and regulation of the load, especially where the load is a negative impedance device such as a discharge lamp.

In order to ignite discharge lamp 37 coupled to secondary winding 39, the open circuit voltage across the secondary must exceed the voltage required to initiate a discharge in the lamp. For the case of a fluorescent lamp load, the transformer also provides the power to produce electron emission of the lamp cathodes, which assists in the initiation of the discharge. Heater windings 41, 42 for the discharge lamp are tightly coupled to the secondary of the transformer such that, when there is no load current flowing, and thus no current in the secondary, the heater windings provide a maximum power transfer to the lamp cathodes.

It is preferable to arrange the transformer so that no portion of the entire transformer will be allowed to saturate at any time, thus providing low power dissipation in the transformer and optimum power coupling.

The transformer secondary is physically separated from the primary. It is a leakage reactance (inductance) which is coupled to the primary only by means of the magnetic field. With no secondary load, the secondary open circuit voltage will be determined by the primary to secondary turns ratio. Before ignition of the lamp, essentially all of the magnetic flux generated by the primary winding links the secondary winding to provide maximum heater power and open circuit voltage. The magnetic circuit for the primary flux before ingnition includes the two ends 72, 74 and the side 76 of hollow cylinder 58, the first and second cylindrical sections 62, 64, disc 66 and first air gap 79. After lamp ignition, a current flows in the secondary winding producing a flux that bucks the primary flux. This causes the magnetic circuit for the primary to change to include one end 72 of hollow cylinder 58, primary cylindrical section 62, first air gap 79, disc 66, second air gap 82 and the side wall 76 of cylinder 58 extending from adjacent the second air gap to end 72. As a result, the flux linkage or coupling to the secondary is reduced after lamp ignition which results in an automatic reduction of the cathode heater power.

The magnetic circuit for the secondary flux after ignition includes the end 74 of hollow cylinder 58, secondary cylindrical section 64, disc 66, second air gap 82 and the walls 76 of cylinder 58 extending from adjacent second air gap 82 to end 74 of cylinder 58.

It is understood that various modifications to the above described arrangement will become evident to those skilled in the art and that the arrangement described is for illustrative purposes only and is not to be considered restrictive.

What is claimed is:

1. A leakage reactance transformer comprising at least two pot cores joined together at their major openings to form a substantially closed hollow cylinder with primary and secondary cylindrically shaped sections extending through the middle of said cylinder, one from each of its ends; the open ends of said sections defining a space therebetween; a disc with two faces disposed in said space, one of said faces being attached to said secondary section with the center of said disc concentric with the center of said secondary section; said disc forming a first air gap between its open face and the open end of said primary section; said disc forming a substantially cylindrical second air gap between its outside edge and the round inside wall of said hollow cylinder; primary winding means wound on said primary section which when connected to a prescribed current cource produces a primary flux; secondary winding means wound on said secondary section which when connected to a particular load produces a secondary flux which bucks said primary flux; and additional winding means wound on said secondary section which when connected in a closed circuit carries a current whose magnitude varies inversely with that of the current in said secondary winding means.

2. A leakage reactance transformer according to claim 1, wherein the magnetic circuit for said primary flux before said secondary winding conducts current includes the two ends and the side of said hollow cylinder, said primary and secondary cylindrical sections, said disc and said first air gap, and wherein the magnetic circuit for said primary flux after said secondary winding conducts includes the one end of said hollow cylinder from which said primary cylindrical section extends, said primary cylindrical section, said first air gap, said disc, said second air gap and the wall of said hollow cylinder from adjacent said second air gap to said one end of said cylinder.

3. A leakage reactance transformer according to claim 2, wherein the magnetic circuit for said secondary flux includes the other end of said hollow cylinder from which said secondary cylindrical section extends, said secondary section, said disc, said second air gap, and the wall of said hollow cylinder from adjacent said second air gap to said other end of said hollow cylinder.

4. In combination with the leakage reactance transformer of any of claims 1, 2 or 3, a fluorescent lamp with heater elements, said heater elements being connected to said additional winding means and an oscillator inverter circuit connected to said primary winding means and which, when connected to a power source, provides current to said primary winding means.

5. The combination according to claim 4 wherein said oscillator-inverter includes a rectifier whose output circuit is connected across a series resistor and capacitor and through a coil to said oscillator.

6. A magnetic transformer switch including a primary section; a secondary section; a connecting section having first and second parts between said primary and secondary sections; a primary winding wound on part of said primary section; and a secondary winding wound on part of said secondary section; said primary section and said secondary section forming a first air gap therebetween; said primary, secondary and connecting sections and said first air gap forming a first primary flux path; said secondary section and said connecting section forming a second air gap; said secondary section and said first part of said connecting section and said second air gap forming a secondary flux path; said primary section, a portion of said secondary section, said first and second air gaps and said second part of said connecting section forming a second primary flux path, whereby in response to a predetermined flux flowing in said secondary flux path as a result of current flowing in said secondary winding said primary flux switches from said first primary flux path to said second primary flux path.

7. A magnetic transformer switch according to claim 6, wherein two pot cores are joined together at their major openings to form a substantially hollow cylinder with a cylindrically shaped section extending through the middle of said cylinder from each of its ends, one of said cylindrically shaped sections being said primary section, the other being part of said secondary section, the free ends of said sections defining a space therebetween.

8. A magnetic transformer switch according to claim 7, including a disc with two faces disposed in said space, one of said faces being attached to the other of said cylindrically shaped sections with the center of said disc being concentric with the center of said other section thereby forming said secondary section, said disc forming said second air gap between its outer edge and the round inner wall of said hollow cylinder.

9. In combination with the magnetic transformer switch of any of claims 5, 6 or 8, wherein taps are connected to portions of said secondary windings to provide heater windings, a fluorescent lamp with heater elements, said heater elements being connected to said heater windings and an oscillator inverter circuit connected to said primary winding and which, when connected to a power source, provides current to said primary winding.

10. The combination according to claim 9, wherein said oscillator-inverter includes a rectifier whose output circuit is connected across a series resistor and capacitor and through a coil to said oscillator.

11. A magnetic transformer switch according to claim 6, wherein said primary, secondary and connecting sections comprise a hollow body; said primary section includes a post-like member centrally disposed in said hollow body from one end thereof; said secondary section includes a post-like member centrally disposed in said hollow body from the opposite end thereof opposed to said first post-like member and said secondary section also includes a widened portion at its end adjacent said primary post-like member; said widened portion and said first post-like member forming said first air gap and said widened portion and the inner walls of said hollow body forming said second air gap.

* * * * *